US005381712A

United States Patent [19]

Head, Jr. et al.

[11] Patent Number: 5,381,712

[45] Date of Patent: Jan. 17, 1995

[54] INFEED SYSTEM FOR A GANG SAW

[75] Inventors: George W. Head, Jr., Snellville; Reginald R. Landers, Monroe; James L. Smith, Moultrie, all of Ga.

[73] Assignee: Forest Products Machinery, Inc., Monroe, Ga.

[21] Appl. No.: 3,317

[22] Filed: Jan. 12, 1993

[51] Int. Cl.[6] ..... B27B 29/06

[52] U.S. Cl. ..... 83/418; 83/361; 83/367; 83/436; 83/412; 83/425.2; 144/245 A; 144/357

[58] Field of Search ..... 83/361, 365, 366, 367, 83/435, 435.1, 435.2, 436, 425.3, 425.2, 412, 418, 415; 144/357, 245 A, 245 B; 198/468.2

[56] References Cited

U.S. PATENT DOCUMENTS

| | | | |
|---|---|---|---|
| 3,983,403 | 9/1976 | Dahlst om et al. | 144/357 |
| 3,985,055 | 10/1976 | Cornell | 83/425.3 |
| 4,074,601 | 2/1978 | Warren et al. | 144/357 |
| 4,147,259 | 4/1979 | Nilsson . | |
| 4,231,460 | 11/1980 | Heikinheimo | 144/357 |
| 4,383,561 | 5/1983 | Gregoire et al. | 144/357 |
| 4,441,537 | 4/1984 | Vartiainen | 144/357 |
| 4,628,781 | 12/1986 | Rowley . | |
| 4,977,805 | 12/1990 | Corley, III | 83/418 |
| 4,996,900 | 3/1991 | Schmidt . | |
| 5,011,001 | 4/1991 | Cameron . | |
| 5,052,885 | 10/1991 | Foster . | |

FOREIGN PATENT DOCUMENTS 1507485 9/1989 U.S.S.R. .

*Primary Examiner*—Eugenia Jones
*Assistant Examiner*—Allan M. Schrock
*Attorney, Agent, or Firm*—Laubscher & Laubscher

[57] ABSTRACT

An infeed system for a gang saw includes at least one loading station laterally displaced from the infeed station of the gang saw, a pivotable skewing tube arrangement operable at the loading station for orienting a two-sided cant to a given orientation relative to a line parallel with the longitudinal horizontal infeed line of the gang saw, thereby to obtain maximum yield from the cant, a lateral transport device operable to transport the skewing tube and the cant from the loading station to a position adjacent the infeed line while maintaining the cant in the desired orientation, and a longitudinal transport device for transporting the properly oriented cant to the gang saw. Preferably, a second loading station is laterally spaced on the opposite side of the infeed line from the first loading station, whereby cants may be selectively supplied to the in-feed station from the large-log and small-log sides of the mill, thus producing maximum production from a single gang saw means.

16 Claims, 9 Drawing Sheets

FIG. 6
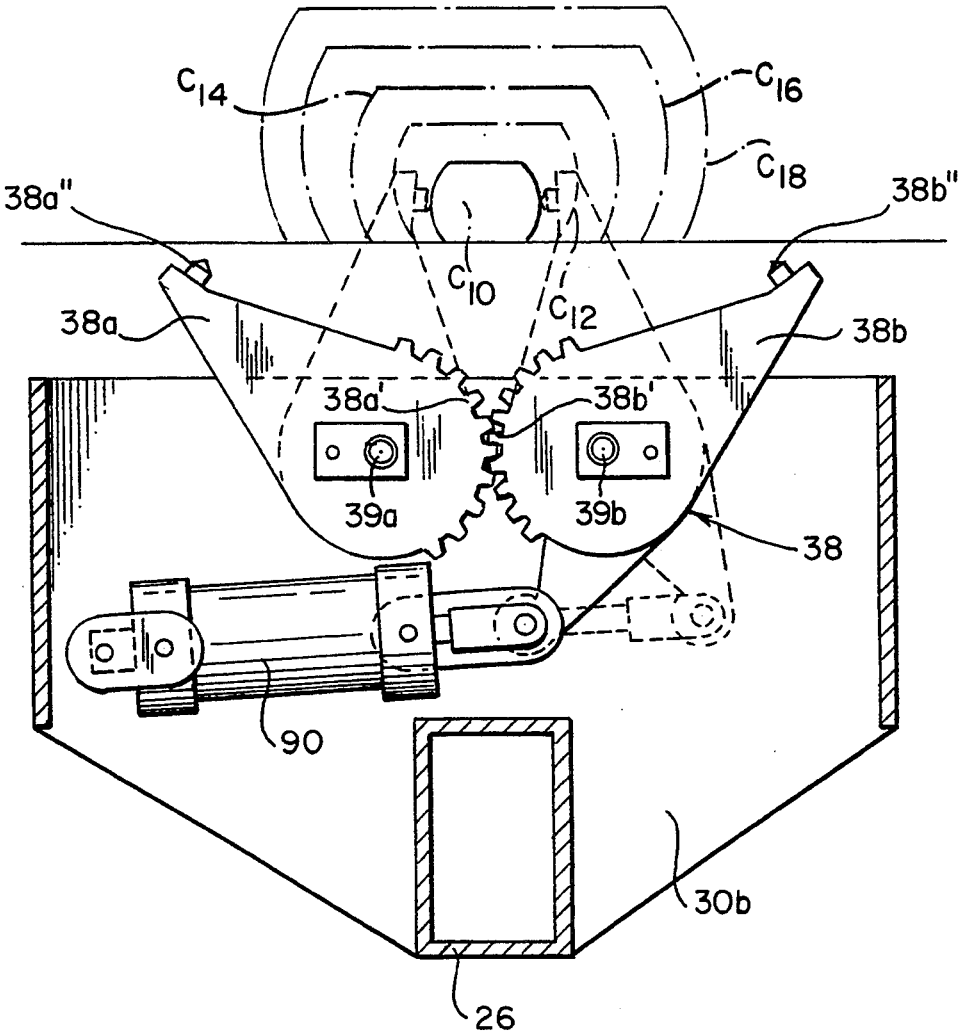
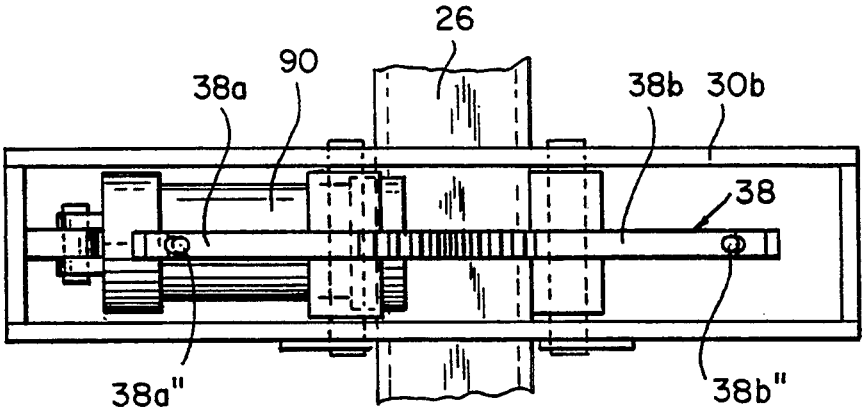
FIG. 7

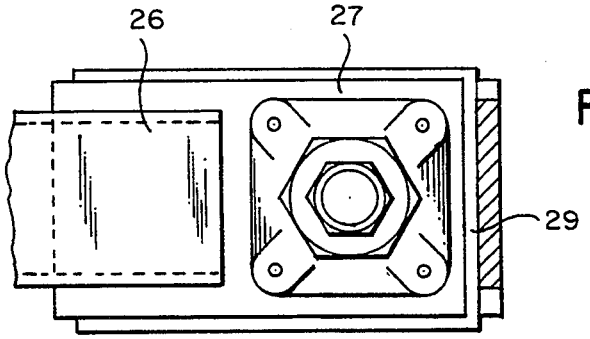
FIG. 10
FIG. 11
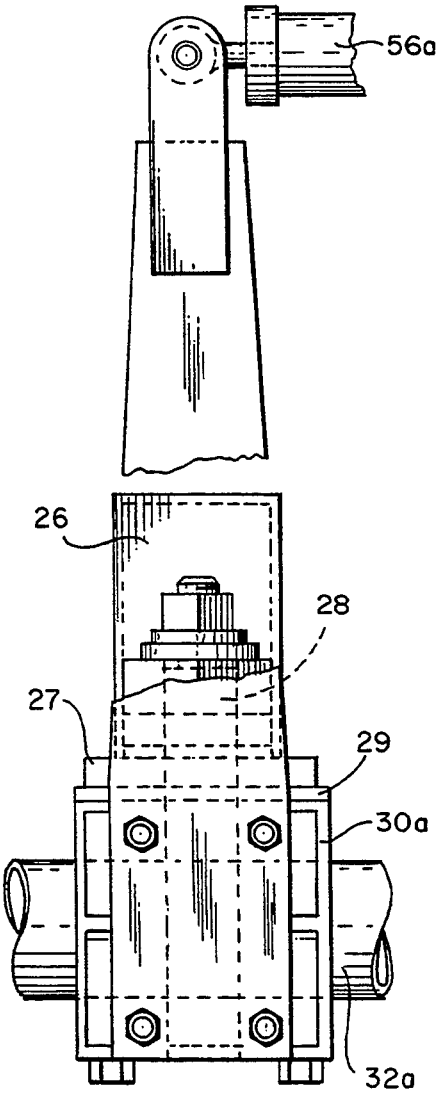
FIG. 9
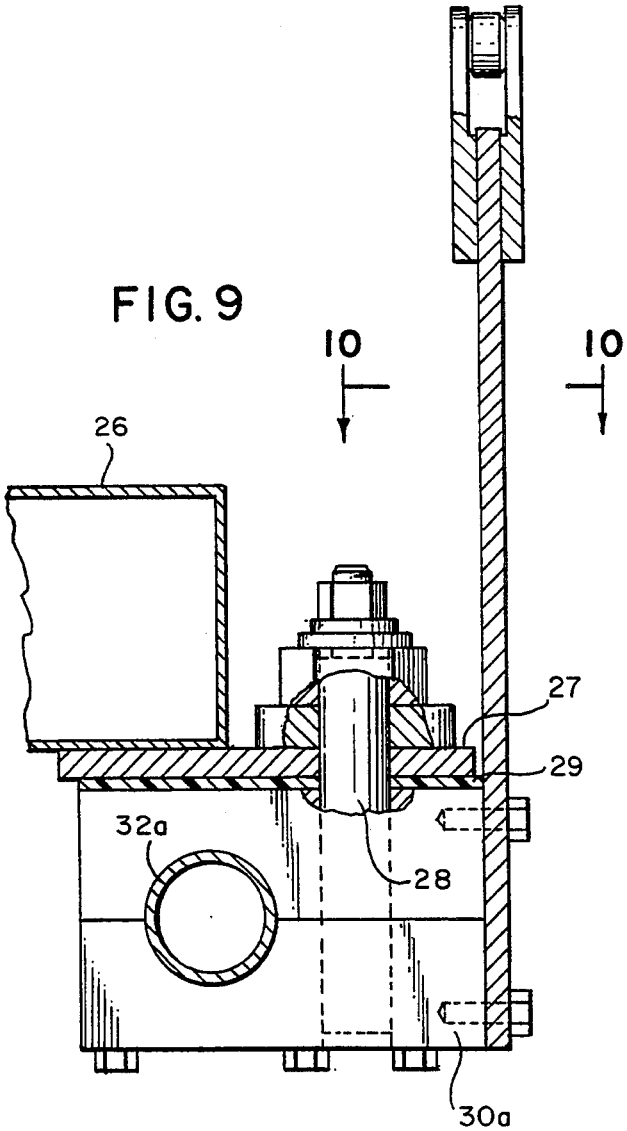

INFEED SYSTEM FOR A GANG SAW

STATEMENT OF THE INVENTION

An infeed system for a gang saw is disclosed including first and second loading stations arranged on opposite sides of a workpiece feeding station, pivotable skewing tube means operable at either of the loading stations for selectively orienting a two-sided cant at a given angular orientation relative to a line parallel with the longitudinal infeed line of the infeed station, and lateral transport means for transporting the skewing tube and the cant, while in the selected state of orientation, from the loading station to a position adjacent the longitudinal infeed line of the feeding station, whereupon the selectively oriented cant is introduced into the gang saw by the feeding rollers.

BRIEF DESCRIPTION OF THE PRIOR ART

It is well known in the patented prior art to provide infeed systems for saw mills, as shown by the patents to Nilsson U.S. Pat. No. 4,147,259, Rowley U.S. Pat. No. 4,628,781, Schmidt et al U.S. Pat. No. 4,996,900, Cameron U.S. Pat. No. 5,011,001 and Foster U.S. Pat. No. 5,052,885.

According to one known arrangement of the prior art, spotting chains are used to transport logs or cants laterally relative to the infeed station of a saw mill, use being made of air bags or the like to raise and lower the spotting chains to lower the logs or cants onto the infeed rollers after the cants have engaged a fixed stop. This system has the drawback that the spotting chains are rather slow in operation and must stay down until the previous cant has cleared the feed rollers, and further that owing to the use of the fixed pin stops, it is not possible to orient the logs or cants relative to the longitudinal infeed line of the sawing station until a prior log has exited the feeding station. This is a particular disadvantage when used with relatively wide gang saws with saw pockets, or combination gang/edgers, since all of the lateral movement translates into the gap between the cants, thereby causing the gang to run empty, thereby resulting in a sawing operation that is slow, uneconomical and wasteful.

In addition to achieving relatively low yield from a given cant, the production rates of the prior systems are relatively low, since the cants can be supplied to the infeed from one side only.

The present invention was developed to provide an infeed system for a gang saw which affords maximum yield from a given two-side cant while affording selective two-side feed of the cants to the feeding table, whereby maximum yield and productivity are achieved.

SUMMARY OF THE INVENTION

Accordingly, a primary object of the present invention is to provide an improved infeed system for a gang saw or the like, wherein two-sided cants may be laterally supplied to the feeding table from either side thereof thereby to increase production from a single saw arrangement. The cants are supplied to loading stations arranged on opposite sides of the feeding station, whereupon prior to lateral transport to the feeding station, a cant at either of the loading stations is selectively oriented by the operator relative to a reference line parallel with the longitudinal infeed axis of the saw means, thereby to effect maximum yield from the cant.

According to a further object of the invention, skewing tube means are provided that are laterally shiftable between the feeding and loading stations and to which a cant is clamped at either loading station, whereupon the skewing tube—with the cant thereon—is selectively oriented relative to a laser beam at either loading station that is parallel with the longitudinal infeed axis of the saw means, the skewing tube maintaining the selected orientation during transport of the skewing tube and the log to the feeding station, whereby upon opening of the clamping means, the cant is deposited on the feed rollers for transport to the saw means while remaining in its selectively oriented position.

A further object of the invention is to provide positioner means including a single linear position motor and a torque tube for accurately displacing the skewing tube between the various loading and feeding stations. The torque tube includes shorter and longer radial arms connected with the positioner motor and with the skewing tube, respectively, thereby affording a mechanical advantage between the movement of the piston of the hydraulic positioner motor and the movement of the skewing tube.

Another object of the invention is to provide width measuring means for measuring the width of the cant as it approaches the loading station, whereby the skewing arm is displaced by the positioner motor means to a position at the loading station corresponding generally with the center of the clamping means, whereby upon activation of the clamping means, the jaws thereof are already positioned to engage opposite surfaces of the cant without any significant displacement of the cant.

BRIEF DESCRIPTION OF THE DRAWINGS

Other objects and advantages of the invention will become apparent from a study of the following specification when viewed in the light of the accompanying drawings in which:

FIG. 6 is a sectional view taken along line 6—6 of FIG. 1, and FIG. 7 is a top view of the apparatus of FIG. 6;

FIG. 9 is a sectional view taken along 9—9 of FIG. 1, and FIG. 10 is a sectional view taken long line 10—10 of FIG. 9;

FIG. 11 is a right hand elevational view of the apparatus of FIG. 9;

DETAILED DESCRIPTION

Figure 1:
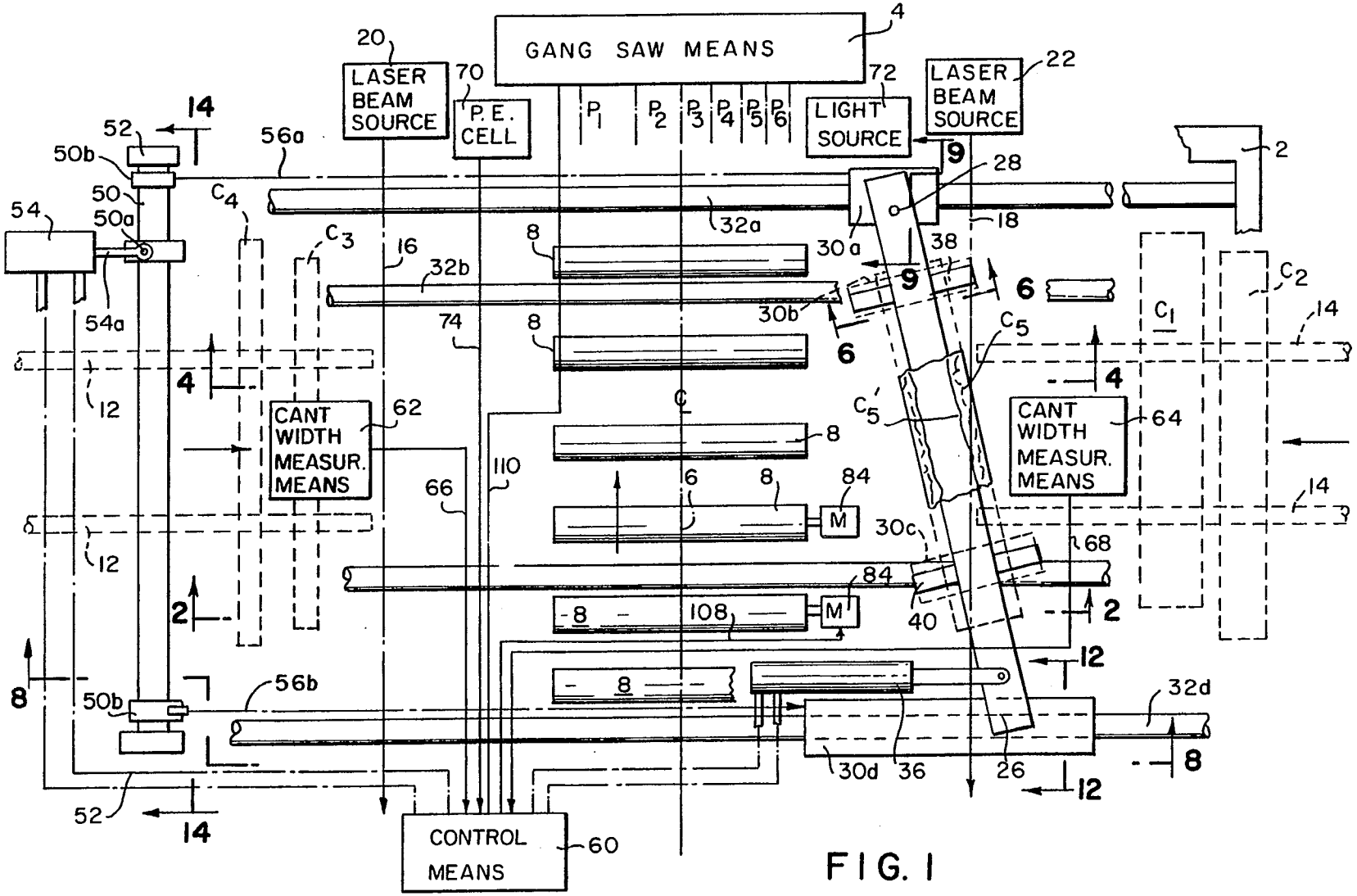
FIG. 1 is a diagrammatic top plan view of the infeed means of the present invention.
Figure 2:
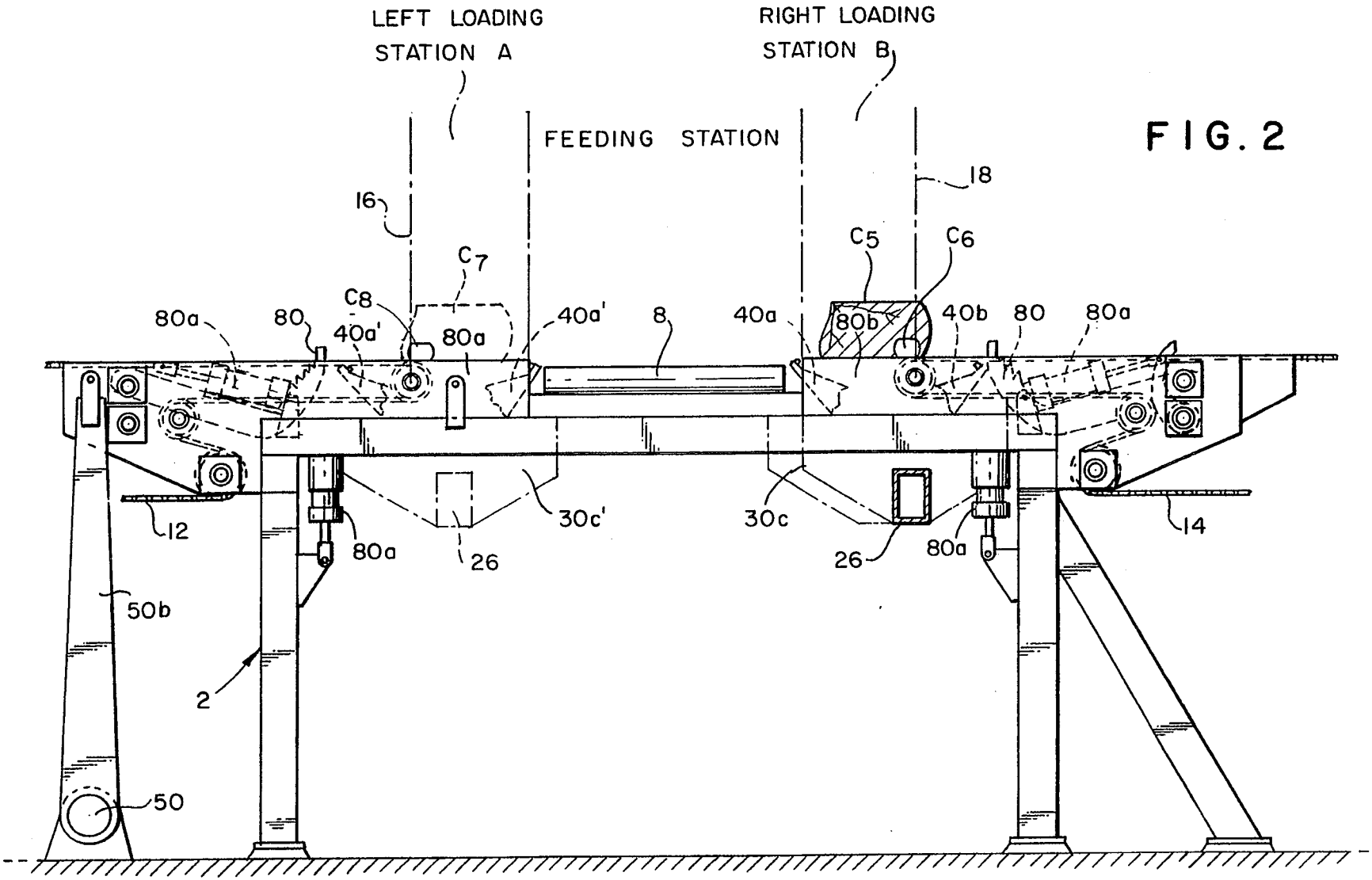
FIG. 2 is a sectional view taken along line 2—2 of FIG. 1.
Figure 3:
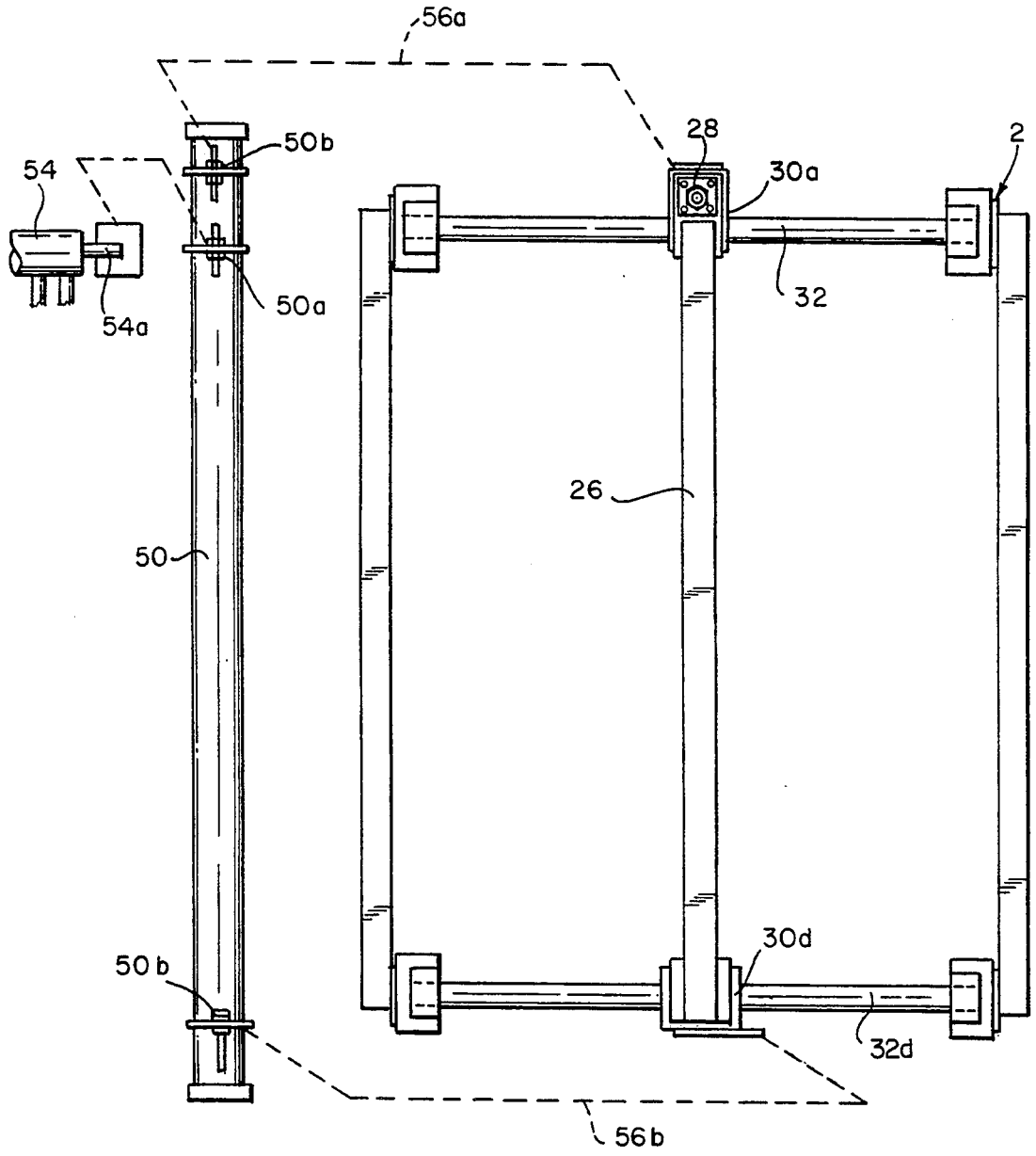
FIG. 3 is a top plan view of the apparatus with certain parts removed for clarity.

Referring first more particularly to FIGS. 1 and 3, the infeed apparatus of the present invention includes a frame 2 that is arranged opposite the infeed side of gang saw apparatus 4 having a horizontal longitudinal infeed center line 6 and including a number of laterally arranged sawing pockets $P_1$–$P_6$ of different sawing widths, respectively. Rotatably driven horizontal feed rollers 8 define a feeding station having a horizontal upper surface for laterally receiving wood pieces, such as two-side cants, and for feeding the same longitudinally toward the gang saw means 4. Relatively large cants $C_1$ and $C_2$ are supplied to the right hand side of the frame from the large-log side of the mill via endless sprocket chains 14, and smaller cants $C_3$ and $C_4$ are supplied from the small-log side of the mill to the left hand side of the frame by endless chains 12. The endless conveying chains terminate at first and second loading stations A and B (FIG. 2) each having a generally horizontally extending laser beam 16 and 18 generated by the laser beam sources 20 and 22, respectively. The laser beams extend parallel with, and are spaced from, the infeed center line 6 of the gang saw means 4.

In accordance with a characterizing feature of the invention, a skewing tube 26 is provided for initially selectively orienting the cants at the loading stations relative to the associated laser beams 16 and 18, respectively, and for subsequently transporting these selectively oriented cants in succession toward the rotatably driven rollers 8 of the feeding station. More particularly, at its end adjacent the gang saw means 4 the skewing tube 26 is pivotally connected by vertical pivot means 28 with a carriage **30*a* that is slidably mounted on a cylindrical way 32*a* the ends of which are supported by the frame 2. Similar horizontal rails 32*b*, 32*c*, and 32*d* are also mounted within the frame in parallel horizontal coplanar relation relative to the first way 32*a*. At its end remote from the gang saw means 4, the skewing tube 26 is slidably supported upon the frictionless upper surface of carriage 30*d* which is slidably mounted on horizontal way 32*d*, as will be described in greater detail below. A hydraulic piston and cylinder skewing motor 36 is connected with the carriage 30*d* for pivoting the skewing tube 26 about its pivot axis 28 relative to carriage 30*a* and the saw centerline 6. A pair of clamping means 38 and 40 are provided for clamping a cant $C_5$ to the skewing tube 26. In order to reduce friction between the carriages and their associated cylindrical ways, the ways are coated with a suitable synthetic plastic material having a low coefficient of friction, such as Rex Duralon. The cant $C_5$ has an outer cant trim line $C_5'$ that is used by the operator to selectively orient the cant C5 relative to laser beam 18, whereby when the cant is subsequently fed into the gang saw means 4**, a maximum yield of dimensional lumber will be produced from the cant with a minimum amount of waste.

In accordance with another important feature of the invention, means including a torque tube 50 are provided for displacing the skewing tube 26 between the feeding station defined by the rotatably driven rollers 8, and the left and right loading stations A and B defined at the ends of the endless conveyor chains 12 and 14, respectively. To this end, the torque tube 50 is rotatably supported in fixed bearings 52 adjacent the left side of the frame 2. The torque tube 50 is provided with a first relatively short radial arm portion **50*a* that is connected with the piston of hydraulic motor means 54. The torque tube is also provided with a pair of parallel upwardly extending relatively longer radial arm portions 50*b* the free extremities of which are connected by links 56*a* and 56*b* with the carriages 30*a* and 30*d*, respectively. The clamping carriages 30*b* and 30*c*, which straddle the skewing tube as shown in FIG. 2, are freely slidable on the associated cylindrical ways 32*b* and 32*c***, respectively.

Operation of the skewing motor 36 and the positioner motor 54 is controlled by control means 60 that is operated by the infeed operator. Cant width measuring means 62 and 64 of the proximity switch type are provided adjacent the first and second loading stations for supplying cant width information to the control means 60 via conductors 66 and 68, respectively. Similarly, a photoelectric cell 70 is provided opposite a light source 72 adjacent the output of the feeding station defined by the feed rollers 8, thereby to supply to the control means via conductor 74 a signal indicating that the prior cant has exited the feeding station and has been introduced to the gang saw means. As shown in FIG. 2, cants $C_5$, $C_6$, $C_7$, and $C_8$ of varying sizes and dimensions may be supplied to the gang saw means 4 via the loading platforms arranged on opposite sides of the gang saw center line means 6. The apparatus is provided with conventional stop and cant turning means 80 having hydraulic motors 80a which form no part of the present invention.

Figure 4:
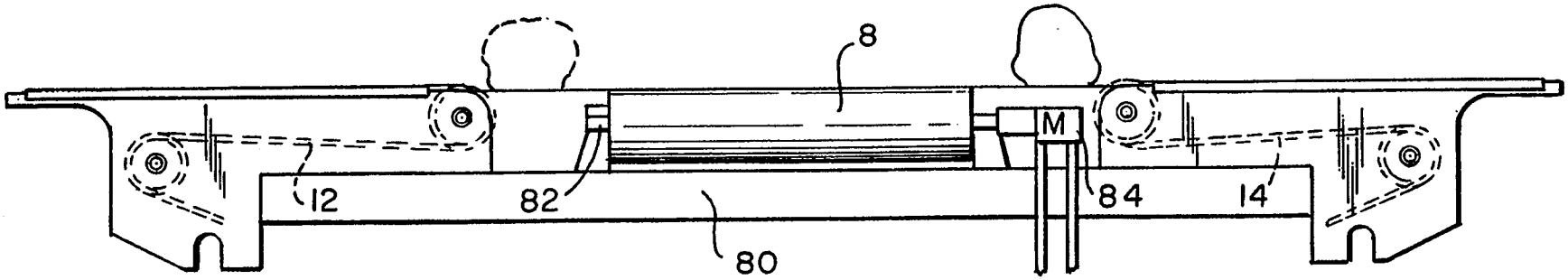
FIG. 4 is a sectional view taken along line 4—4 of FIG. 1.
Figure 5:
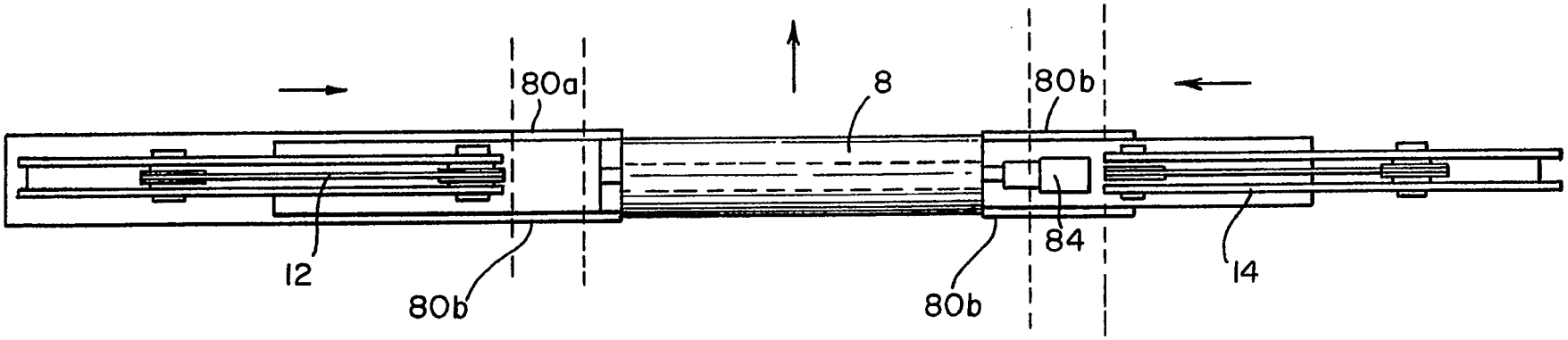
FIG. 5 is a top plan view of the apparatus of FIG. 4.

Referring now to FIGS. 4 and 5, the drive rollers 8 are mounted on cross beams 80 by fixed bearing means 82, each roller being driven by a separate hydraulic motor 84. According to an important feature of the invention, the cants are deposited on the upper edges of the parallel beam side plates **80*a* and 80*b* arranged at the extremities of the conveyor chains 12 and 14 at positions adjacent and generally parallel with the associated laser beams 16 and 18**, respectively.

Referring now to FIGS. 6 and 7, the clamp means 38 include a pair of jaws **38*a* and 38*b* that pivot about axes 39*a* and 39*b*, respectively, relative to the clamping block 30*b* mounted on skewing tube 26. The clamping jaws are connected at their adjacent ends by enmeshing integral pinion teeth 38*a*' and 38*b*', whereby the clamping jaws 38*a* and 38*b* are simultaneously operable by the clamping cylinder 90, thereby to engage cants of different size (such as cants $C_{10}$, $C_{12}$, $C_{14}$, $C_{16}$, of FIG. 6). At their free extremities, the jaws are provided with sharp projections 38*a*'' and 38*b*'' that engage the outer surfaces of diametrically opposed portions of the cant, which cant is initially at the height of the loading platform (which is slightly higher than the height of the feeding station, as will be described below). Similarly, clamp means 40 includes a pair of pivotally mounted jaws 40*a*, 40*b* (FIG. 2) carried by clamping block 30*c* mounted on skewing tube 26**.

As shown in FIGS. 9–11, the skewing tube 26 is pivotally connected with carriage **30*a* by vertical pivot shaft 28, the carriage 30a being mounted for sliding movement upon the cylindrical way 32*a*. More particularly, the skewing tube 26 is welded to a pivot plate 27 having a smooth lower surface that is supported by a suitable Teflon-like synthetic plastic layer 29 having a low coefficient of friction (such as the material identified as MC 901 produced by The Polymer Corporation). As shown in FIG. 11, the carriage 30*a* is connected at its upper end with a link 56*a* the other end of which is connected with the longer arm 50*b* of the torque tube 50, as shown in FIG. 1**.

Referring to FIGS. 8 and 12–15, at its other end, the skewing tube 26 is connected with a support plate 31 having a smooth lower surface that is in sliding engagement with a layer 33 of suitable Teflon-like synthetic plastic material having a low coefficient of friction (for example, the aforementioned product MC 901.

The skewing tube 26 is laterally displaced relative to the carriage 30d by the hydraulic skewing motor 36. The cylinder of the motor 36 is connected with the skewing tube 26 by trunnion means 37 and integral support plate 26a, and the piston rod 36*a* of the motor is connected by clevis means 39 with the carriage plate 30*d'*. The skewing cylinder 36 has a stroke of about 12 inches, whereby the skewing tube may be laterally displaced relative to carriage 30*d* through a distance d (FIG. 13) of about 9 inches (which distance, of course, has been greatly exaggerated by purposes of illustration in FIG. 1). Link 56*b* connects the upper end of the carriage 30*d* with the corresponding longer arm 50*b* of the torque tube 50, and the shorter arm 50*a* of the torque tube is connected with piston rod 54*a* of the positioner hydraulic motor 54 as shown in FIG. 8.

Figure 8:
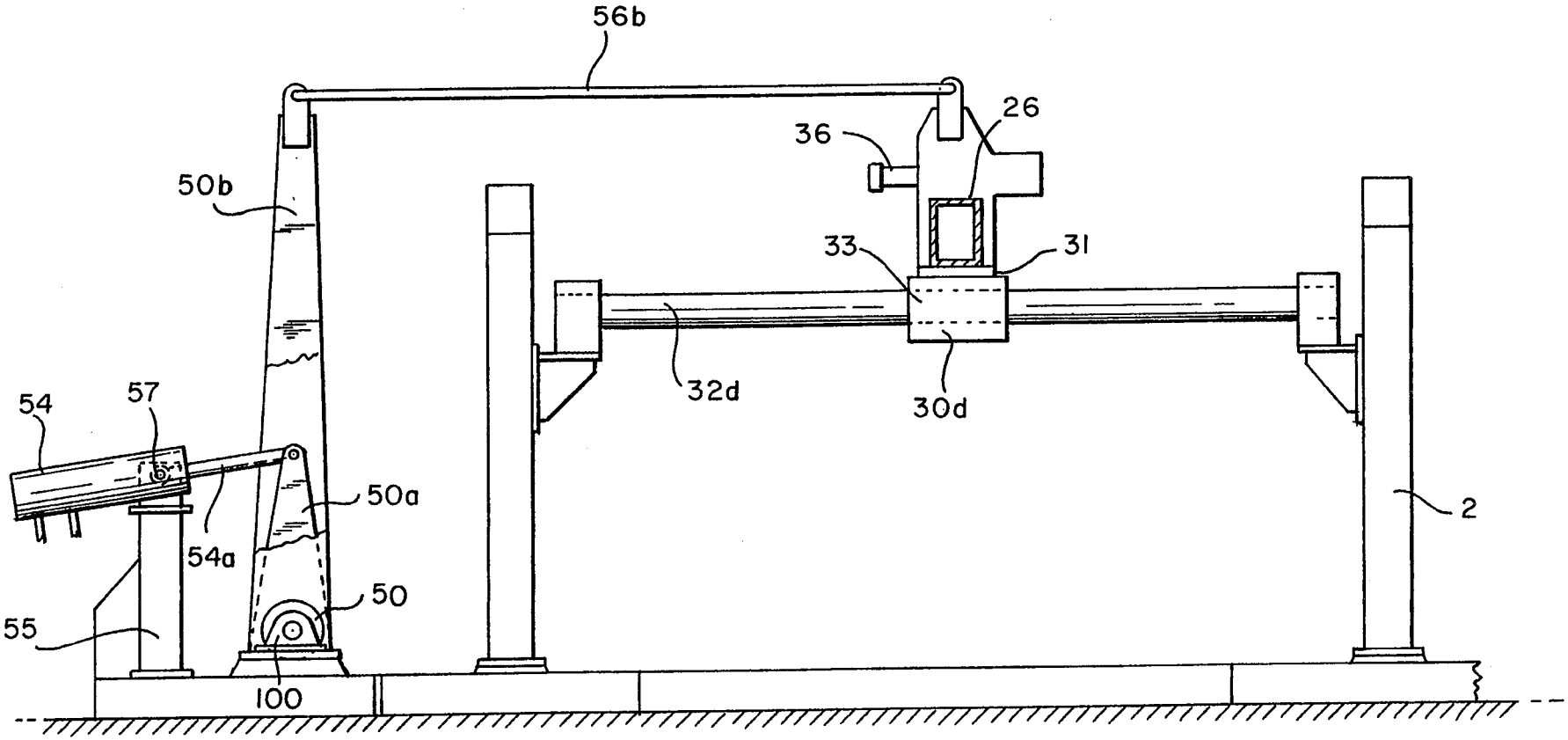
FIG. 8 is a sectional view taken along line 8—8 of FIG. 1.
Figure 13:
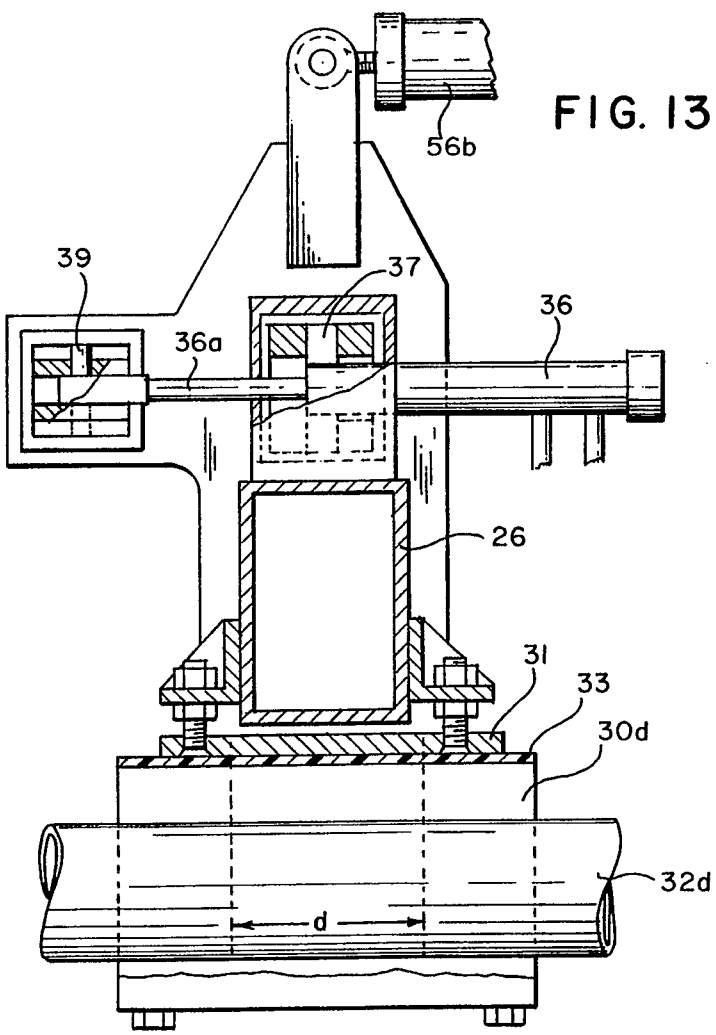
FIG. 13 is a sectional view taken along line 13—13 FIG. 12.
Figure 12:
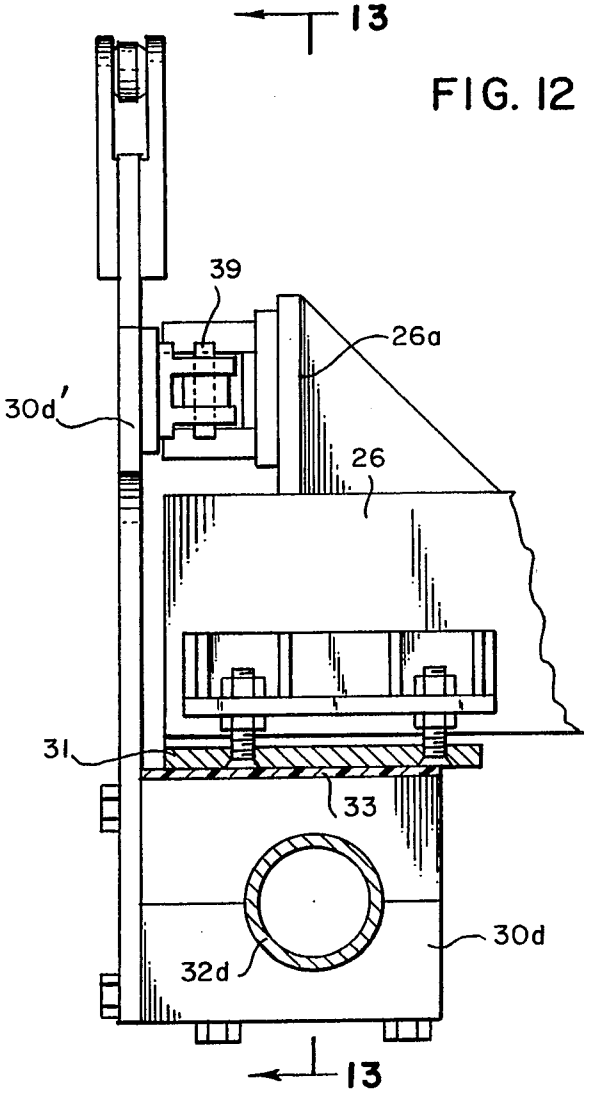
FIG. 12, is a sectional view taken along line 12—12 of FIG. 1.

As shown in FIG. 8, the cylinder of the positioner motor 54 is connected with a fixed pedestal 55 by trunnion 57.

Figure 16:
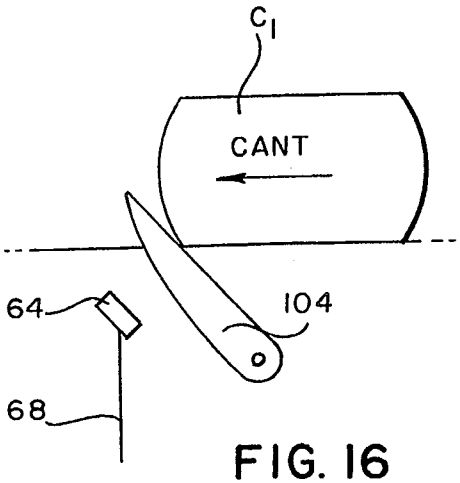
FIG. 16 is a diagrammatic view illustrating the operation of the proximity switch cant width measuring means of FIG. 1.
Figure 15:
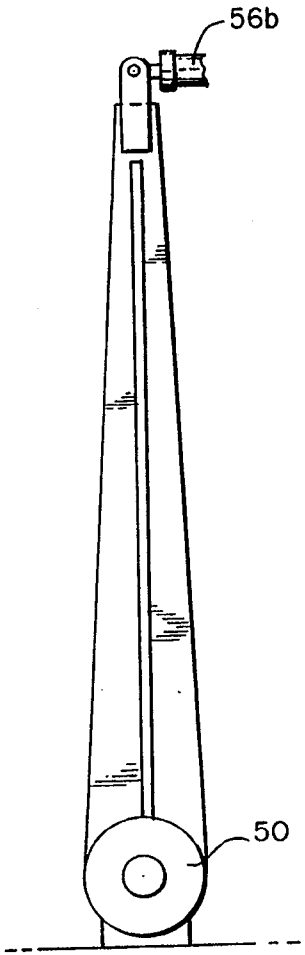
FIG. 15 is a left-hand end view taken along line 15—15 of FIG. 14.
Figure 14:
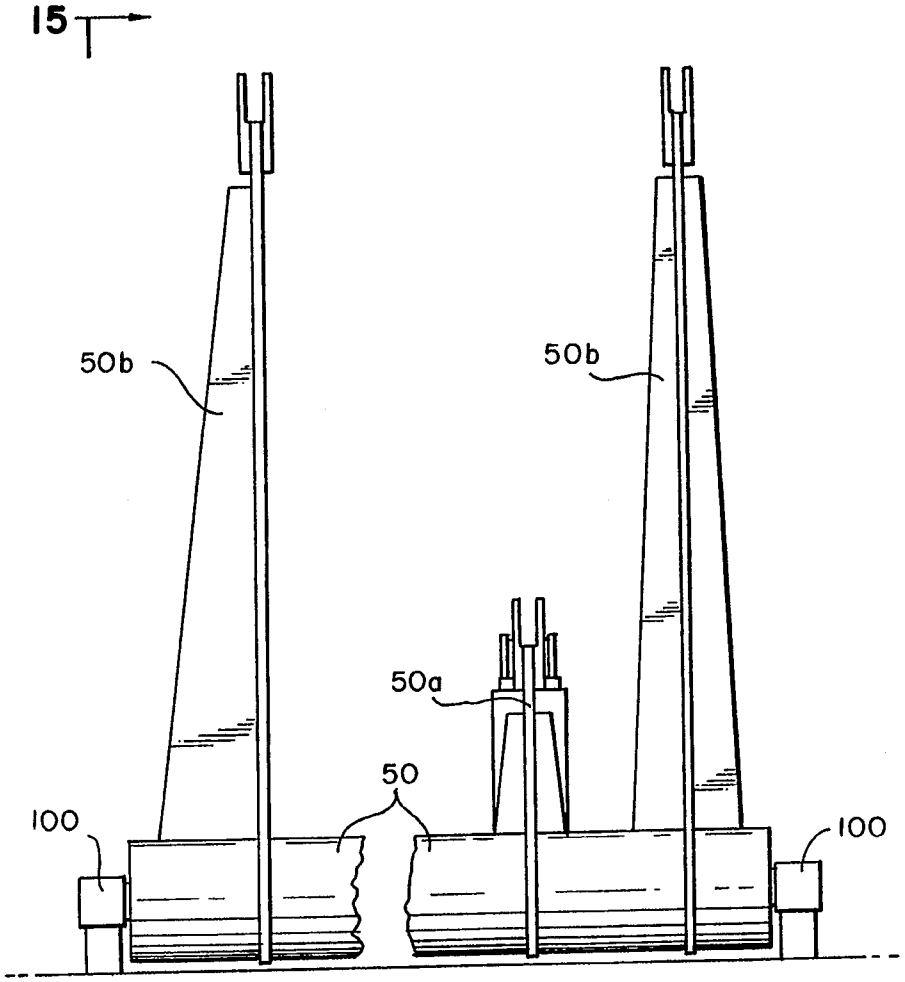
FIG. 14 is a sectional view taken along line 14—14 FIG. 1.

Referring now to FIG. 16, the width of a cant $C_1$ is determined by the amount of time that a pivotally mounted feeler member 104 is displaced by the cant toward a proximity switch 64 of the photoelectric cell or infrared sensor type that is connected by a conductor 68 with the control means 60. Thus, the longer that the pivotally mounted feeler member 104 is in engagement with the lower surface of the travelling cant 61, the greater will be the width dimension measured by the proximity switch 64.

Operation

In operation, assume that cants from the large-log mill are supplied via conveyor chains 14 to the right hand side of the frame 2, and that cants of smaller dimensions are supplied to the left hand side of the frame from the small-log mill via endless chains 12. Assume also that the cant $C_5$ has been fed by the chain 14 to the right loading station as shown in FIGS. 1 and 2. The width of this cant has been measured by the cant width measuring means 64, and a corresponding signal has been transmitted to the control means 60 via conductor 68. This cant width signal automatically supplies a signal to the motors 84 associated with the feed rollers 8, respectively, so that the speed of these motors is a function of the cant width. Similarly, a speed control signal is supplied to the gang saw means 20 via conductor 110, whereby the speed of the gang saw means corresponds with the cant width. Finally, the cant width signal controls the operation of the positioned motor 54 to position the carriages 30*a* and 30*d* at a given position at the right hand loading station corresponding with the width of the cant, whereby the clamping means 38 and 40 are generally centered relative to the cant 5. The cant 5 is supported by the side plates 80*b* (FIG. 4) with the right hand trim line $C_5'$ of the cant adjacent the laser beam 18 produced by laser beam source 22. The operator at control means 60 then operates the clamping motors 90 to cause the clamping jaws of the clamping means 38 and 40 to pivot together into engagement with opposite sides of the cant $C_5$, whereupon the operator operates the skewing motor 36 to orient the cant $C_5$ relative to the laser beam 18 and, consequently, relative to the center line 6 of the gang saw means 4, thereby to achieve maximum yield from the irregular-shaped cant. The operator then visually makes a determination as to which of the pockets $P_1$–$P_6$ of the gang saw means he wishes to introduce the cant in order to achieve maximum yield from that cant. After making this determination, the operator sends the appropriate signal to the torque tube motor 54 to displace the shorter arm 50*a* to an extent to cause the longer arms 50*b* to shift the carriages 30*a* and 30*d* to the appropriate position longitudinally of the selected pocket. For example, assume that the operator wishes to introduce the cant $C_5$ into the pocket $P_1$. The cant, while maintained in the orientation produced by the skewing motor 36, is transported by the positioner motor 54 and the torque tube 50 to the position at which the skewing tube 26 is generally opposite pocket $P_1$. When the selectively oriented cant $C_5$ is at the position generally opposite the pocket $C_1$, the operator pushes the appropriate control button to open the clamp means 38 and 40, whereupon the cant $C_5$ is deposited upon the feed rollers 8 for transport to the gang saw means 4. Thus, the cant is introduced into the pocket which will produce the greatest yield for the cant, which has maintained the selective orientation that was produced relative to laser beam 18 at the right hand loading station.

Assume now that cant $C_3$ has been transported by chains 12 to the left hand loading station supported by the plates 80*a*, and that the next cant $C_1$ has been transported by the endless chains 12 to the right hand loading station on plates 80*b*. Assume further that the operator chooses to feed to the gang saw means the cant $C_3$ at the left hand loading station. The carriages 30*a* and 30*d* are transported by the torque tube 50 and the positioning motor 54 to displace the skewing tube 26 to a position at the left hand loading station that is a function of the width of the cant as determined by the cant width measuring means 62. As the torque tube 26 is displaced by the moving carriages 30*a* and 30*d*, it also causes corresponding movement of clamping blocks 30*b* and 30*c*. The torque tube now is at a position at which the left hand cant trim edge of the cant $C_3$ is adjacent the laser beam 16 produced by source 20, whereupon the clamping means 38 and 40 are operated to engage the cant $C_3$, and skewing motor 36 is operated to effect a desired position of the left cant trim line of cant $C_3$ relative to laser beam 16. If the prior cant $C_5$ has not yet left the feeding station defined by the rollers 8, the photoelectric cell 70 will sense the obstruction of light from the source 72, and will control the positioner motor 54 to prevent movement of the torque tube 50 and the carriages 30*a* and 30*d* to the right until the previous cant $C_5$ has completely exited the feeding station. After the cant has cleared the feeding station and the speed of the feed rollers and the gang saw means has been adjusted as a function of the width of the cant $C_3$, motor 54 is operated to displace carriages 30*a* and 30*d*—together with clamping blocks 30*b* and 30*c*—to the right, thereby to displace the skewing tube 26 to a position opposite the appropriate pocket selected by the operator in accordance with the width of the cant, as well as its orientation as selected by its relationship relative to the laser beam 16. The selectively oriented cant $C_3$, when positioned opposite the desired pocket, maintains its selected orientation as the clamps 38 and 40 are opened to deposit the cant $C_3$ onto the feed rollers 8. Thus, the cant retains its selected orientation during the time that it is fed into the gang saw means 4.

It is apparent that by appropriate adjustment of the skewing tube 26 as controlled by hydraulic motor 36, maximum yield from the cant is produced, and since the cants of various widths and lengths are fed from either side of the centerline 6 of the gang saw means, the production rate of the mill is greatly increased. Furthermore, while one cant is being fed by rollers 8 into the gang saw means 4, the skewing arm may be positioned for clamping with a desired subsequent cant, at either loading station, whereupon the skewing motor 36 may be operated to give the cant a desired orientation, so that when the previous cant has exited the feeding means as determined by the photoelectric cell 70, the subsequent cant is ready for immediate introduction into the feeding station.

A major advantage afforded by the torque tube arrangement is that through the use of the short and long torque tube arms 50*a* and 50*b*, a linear positioner motor 54 having a relatively short standard stroke (for example, 36 inches) may be used to displace the skewing tube a substantial distance (for example, 9 feet, as required for use with a gang saw having a 5 foot width, and a pair of loading stations each having a 2 foot width). Thus the operator may cause the linear positioner motor to instruct a selectively oriented cant to go to a specific pocket without having to move it into position himself. From the fixed reference point (i.e., the laser beam) at each loading station, it is a given distance to any saw pocket of the gang, and therefore the linear positioner may be instructed to move to any point along its axis of movement to plus or minus 0.003 inch accuracy, thereby to position the cant automatically for entry into a selected gang saw pocket. To assist the operator in making this decision, indicia corresponding to the location of the blades of the gang saw may be marked on the feed rollers adjacent the operator.

Another advantage of the invention is that the cants are automatically positioned at the loading stations at the ends of the conveying chains, whereby the trailing cant trim line is automatically positioned adjacent the laser beam at that station, thus minimizing the effort required by the operator to align the cant for both lateral and skewing movement.

While in accordance with the provisions of the Patent Statutes the preferred forms and embodiments of the invention have been illustrated and described, it will be apparent the various changes may be made without deviating from the inventive concepts set forth above.

What is claimed is:

1. Infeed apparatus adapted for use with wood cant sawing means (4) having a horizontal central longitudinal infeed axis (6), comprising:

(a) longitudinal transport means (8) having a transport axis generally colinear with the sawing means infeed axis, said transport means defining a cant feeding station;

(b) skewing means (26) operable at a first loading station (B) arranged in horizontal parallel laterally-spaced relation relative to said longitudinal transport means for pivoting a first cant ($C_5$) in a horizontal plane about a vertical axis normal to its longitudinal axis toward a given angular orientation relative to a first reference line (18) parallel with and spaced from said transport axis; and (c) lateral transport means (50) for laterally displacing said skewing means and said first cant, while in said given angular orientation, from said first loading station toward said cant feeding station; said first cant, while in said given angular orientation, from said infeed station longitudinally toward said saw means, thereby to obtain maximum yield from (d) said skewing means being operable independently of said transport means to pivot a second cant toward a desired angular orientation relative to a reference line parallel with said transport axis simultaneously with the transport of said first cant to the sawing means.

2. Infeed apparatus for feeding wood cants to wood cant sawing means (4) having a horizontal central longitudinal infeed axis (6), comprising:

(a) longitudinal transport means (8) having a transport axis generally colinear with the sawing means infeed axis, said transport means defining a cant feeding station;

(b) skewing means (26) operable at a first loading station (B) arranged in horizontal parallel laterally-spaced relation relative to said longitudinal means for pivoting a first cant ($C_5$) in a horizontal plane about a vertical axis normal to its longitudinal axis toward a first angular orientation relative to a first reference line (18) parallel with and spaced from said transport axis; and (c) lateral transport means (50) for laterally displacing said skewing means and said first cant, while in said given angular orientation, from said first loading station toward said cant feeding station;

(d) said skewing means being operable independently of said transport means at a second loading station (A) arranged in spaced relation relative to said transport axis on the other side thereof from said first loading station to pivot a second cant ($C_7$) in a horizontal plane about an axis normal to its longitudinal axis toward a second angular orientation relative to a second reference line (16) parallel with and spaced from said transport axis, thereby to permit orientation of said second cant during the transport of said first cant to the sawing means, said lateral transport means being subsequently operable to displace said skewing means and said second cant, while in said second orientation, from said second loading station toward said cant feeding station.

3. Apparatus as defined in claim 2, wherein said cants comprise two-sided cants and further including:

(e) means for generating a pair of laser beams at said first and second loading stations, respectively, said laser beams extending in directions parallel with said transport axis to define said first and second reference lines, respectively, whereby the operator may orient the cant relative to said transport axis as a function of the visual position of a cant face line of the cant relative to the laser beam.

4. Apparatus as defined in claim 3, wherein said saw means includes gang saw means having a plurality of laterally spaced pockets corresponding to various widths of cut, respectively; and further including means controlling the operation of said lateral transport means to position the wood piece laterally relative to said infeed line in accordance with the width of the cant.

5. Infeed apparatus adapted for use with wood cant sawing means (4) having a horizontal central longitudinal infeed axis (6), comprising:

(a) a frame (2);

(b) skewing means (26) initially operable at a first loading station (B) arranged in horizontally spaced relation relative to said infeed axis for pivoting a first cant ($C_5$) in a horizontal plane about an axis normal to its longitudinal axis toward a given angular orientation relative to a first reference line (18) parallel with and spaced from said infeed axis, said skewing means being subsequently operable at a second loading station (A) arranged in spaced relation to said saw infeed axis on the other side thereof from said first loading station to pivot a second cant in a horizontal plane about an axis normal to its longitudinal axis toward a given angular orientation relative to a second reference line (16) parallel with and spaced from said infeed axis, said lateral transport means being operable to displace said skewing means and said second cant, while in said given orientation, from said second loading station toward said infeed station;

(c) lateral transport means (50) for laterally displacing said skewing means and said cant, while in said given angular orientation, from either of said loading station toward an infeed station containing said infeed axis; and (d) longitudinal transport means (8) for displacing said first cant, while in said given angular orientation, from said infeed station longitudinally toward said saw means, thereby to obtain maximum yield from the first cant;

(e) said skewing means including:

(1) carriage means (**30*a*, 30*d***) connected with said frame for displacement between said first and second loading stations;

(2) a skewing tube (26);

(3) means (28) pivotally connecting said skewing tube with said carriage means for pivotal movement about a vertical pivot axis;

(4) clamping means (38, 40) for clamping said cant with said skewing tube; and (5) means (36) for pivotally displacing said skewing tube relative to said carriage means toward a desired angular position relative to one of said reference lines.

6. Apparatus as defined in claim 5, wherein said carriage means is slidably connected with said frame for lateral displacement relative to said infeed axis.

7. Apparatus as defined in claim 4, wherein said frame includes a plurality of horizontal parallel spaced cylindrical ways extending normal to said in-feed axis, said carriage means including a plurality of carriages slidably mounted on said cylindrical ways, respectively.

8. Apparatus as defined in claim 5, wherein one end of said skewing tube adjacent the saw means is pivotally connected with an adjacent first carriage , and further including means supporting the thru end of said skewing tube that is remote from said saw means for horizontal sliding movement relative to an associated second carriage.

9. Apparatus as defined in claim 8, wherein said skewing tube displacing means includes a hydraulic piston-cylinder connected between said skewing tube and said second carriage.

10. Apparatus as defined in claim 5 wherein said first and second loading stations have a slightly higher elevation than said longitudinal transport means; and further wherein said clamping means is operable between a closed condition for clamping the cant at said higher elevation when said skewing tube is at one of said first and second loading stations, and an open condition for depositing the cant upon said longitudinal transport means when adjacent said infeed axis.

11. Apparatus as defined in claim 10, wherein said clamping means includes a clamping block (**30*b*, 3*c*) mounted on said skewing tube, a pair of clamping jaws each pivotally connected with said clamping block, gear teeth means connecting said clamping jaws for simultaneous movement toward and away from each other when in the closed and open conditions relative to the cant, respectively, and hydraulic piston-cylinder motor means (90**) mounted on said clamping block for operating said clamping jaws between their closed and open conditions relative to the cant, respectively.

12. Apparatus as defined in claim 11, and further including width sensing means for sensing the width of a cant prior to the conveyance thereof to the associated loading station, and means responsive to said width sensing means for placing said skewing tube at a desired position adjacent the workpiece prior to the operation of said clamping jaws.

13. Apparatus as defined in claim 5, wherein said lateral transport means includes:

(1) a torque tube (50) mounted on said frame for rotation adjacent one side of said frame, said torque tube extending parallel with said infeed line;

(2) linkage means (**56*a*, 56*b*) connecting said torque tube with said carriage means; and (3) means including a linear positioner hydraulic piston-cylinder motor (54**) for pivoting said torque tube to displace said carriage means between said first and second loading stations and said infeed station, respectively.

14. Apparatus as defined in claim 13, and further wherein said lateral transport means includes means (**50*a*, 50*b***) affording a mechanical advantage to provide greater displacement of said skewing means relative to said transport axis than a given displacement of the hydraulic piston-cylinder motor.

15. Apparatus as defined in claim 14, wherein said mechanical advantage means includes a first radial arm means on said torque tube for connecting said torque tube with said linear positioner motor, and second radial arm means on said torque tube for connecting said torque tube with said skewing tube carriage means, said second radial arm means having a greater length than said first radial arm means.

16. Apparatus as defined in claim 13, and further including workpiece sensing means (70) mounted on said frame for preventing operation of said lateral transport means until the previous cant has exited from the infeed station.

* * * * *